United States Patent [19]

Kuhl et al.

[11] 4,415,219

[45] Nov. 15, 1983

[54] CONNECTOR WITH REMOVAL STRESS RELIEF CONSTRUCTION

[75] Inventors: Virgil F. Kuhl, Tamarac; Gary J. White, Plantation, both of Fla.

[73] Assignee: Motorola, Inc., Schaumburg, Ill.

[21] Appl. No.: 292,305

[22] Filed: Aug. 12, 1981

[51] Int. Cl.[3] ..... H01R 33/74

[52] U.S. Cl. ..... 339/195 M; 339/176 M

[58] Field of Search ..... 339/45 R, 45 M, 45 T, 339/46, 176 R, 195 R, 195 M, 176 M

[56] References Cited

U.S. PATENT DOCUMENTS

| | | | |
|---|---|---|---|
| 3,320,573 | 5/1967 | Machts et al. | 339/185 |
| 3,560,907 | 2/1971 | Heller | 339/176 M X |
| 3,701,071 | 10/1972 | Landman | 339/4 |
| 3,795,885 | 3/1974 | Desso et al. | 339/17 F |
| 3,936,129 | 2/1976 | Guy | 339/103 R |
| 4,010,992 | 3/1977 | Crimmins et al. | 339/17 CF |
| 4,112,941 | 9/1978 | Larimore | 339/46 X |

*Primary Examiner*—Mark Rosenbaum

*Attorney, Agent, or Firm*—Joan Pennington; James W. Gillman; Edward M. Roney

[57] ABSTRACT

A low profile electrical connector assembly for insertion into a mating socket having a connector body whose pin to lead wire input configuration is non-linear. The connector body includes a nose-like projection which acts to reduce the lateral stress imposed on the connector pins when the assembly is removed from its mating socket by a pulling force exerted on the lead wires.

5 Claims, 12 Drawing Figures

ARC LENGTH $P_1$ TO $P_2 = r \cdot \beta$ (RADIANS)

Fig. 5B
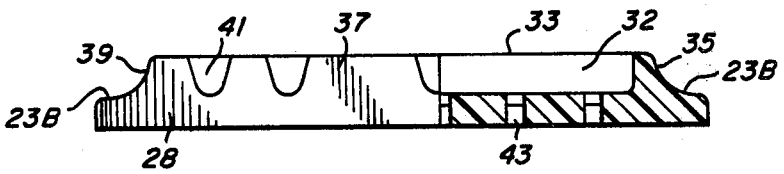
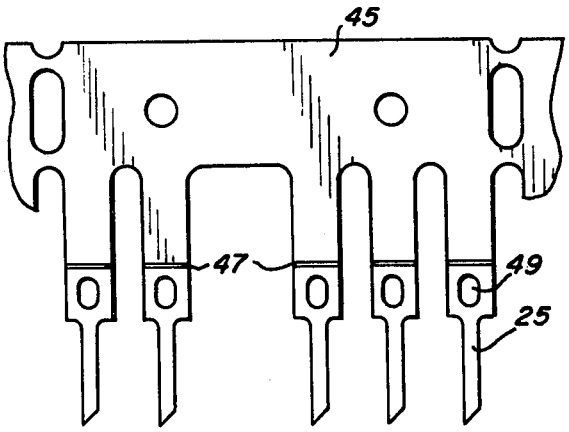
Fig. 5C
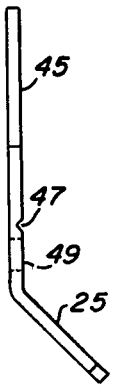
Fig. 5D

CONNECTOR WITH REMOVAL STRESS RELIEF CONSTRUCTION

BACKGROUND OF THE INVENTION

1. Field of the Invention

This invention relates, in general, to electrical connectors and more particularly to electrical connectors with non-linear input lead wire to connector output pin configurations. Such configurations often result in a lateral force imparted on the pins which is capable of permanently bending the connector pins when a connector is removed from its mating socket by pulling force exerted on the lead wires.

2. Prior Art

Ordinarily when connectors are removed from their mating sockets, care must be taken that the pins are not bent. To do this the connector and its associated pins must be carefully pried away in a direction normal to the surface of their mating socket using ones fingers or an appropriate tool. Only connectors with pins and lead wires in a linear relationship are not subject to pin damage when the connector is removed from its mating socket by pulling on the lead wires. For these connectors removal by pulling the lead wires is quick and easy. But unfortunately a direct pull on the lead wire bundle of a connector whose pins and lead wires are in something other than a linear relationship will result in the placement of a lateral force on the pins as they disengage the mating socket. Very often the pins yield strength is surpassed by the lateral force which results in connector pins being bent out of alignment with the mating socket, thus making it difficult or impossible to reinsert the connector in the socket without first realigning them. This is time consuming and can potentially effect the integrity of the electrical connection provided by the connector. If the pins must be straightened more than several times, the thin metal pins will become subject to fatigue resulting in the pins breaking off at an area proximate to the the bend.

It is the general objective of this invention to provide an inexpensive electrical connector that overcomes the foregoing deficiencies while maintaining a connector assembly that has a low profile, easy assembly and high-yield construction.

More particularly, it is the object of this invention to provide an electrical connector assembly which has a lever arm camming action which reduces the lateral stresses on the connector pins as the connector is removed from its mating sockets when pulled by its lead wires.

SUMMARY OF THE INVENTION

Briefly, the invention is directed to an inexpensive electrical connector which decreases the lateral strain placed upon the connector pins when removed from their socket by a pulling force exerted on the wire leads of the connector whose design requires both low profile and minimum surface area. A nose-like projection part of the connector body acts as a lateral stress releiver as the pins of the connector are removed by a pull on the lead wires, whose inputs are located on a side surface of the connector body. The projection acts to reduce the angle the pins must flex while it is being removed, thus reducing the stress on the pins and minimizing the possibility of surpassing the yield strength of the pins and causing a permanent bend in the pins. Also, the nose-like projection acts initially to allow the pins a maximum lever arm to affect their removal from the mating socket. As the connector leads are pulled, the lever arm length for each connector pin changes. Depending on the location in the connector pin row of a particular pin, the lever arm may shorten or lengthen as the point of contact between the connector body and the mating socket cams toward either end of the connector body. For the pins closest to the connector end toward which the connector body is camming, the lever arm is shortening as the camming progresses. But as this continues, all the pins are always sufficiently removed from their mating sockets so that the angle to which they must bend as they are removed is not so great that the yield strength of the exposed portion of the pin is overcome.

BRIEF DESCRIPTION OF THE DRAWINGS

FIG. 5*b* is a partial cross-sectional view along the back side of the FIG. 5*a* connector.

FIG. 5*c* is a top view of connector pins in a preliminary manufacturing state according to the preferred embodiment of the invention.

FIG. 5*d* is a side view of the connector pins in FIG. 5*c*.

DESCRIPTION OF THE PREFERRED EMBODIMENT

Figure 1:
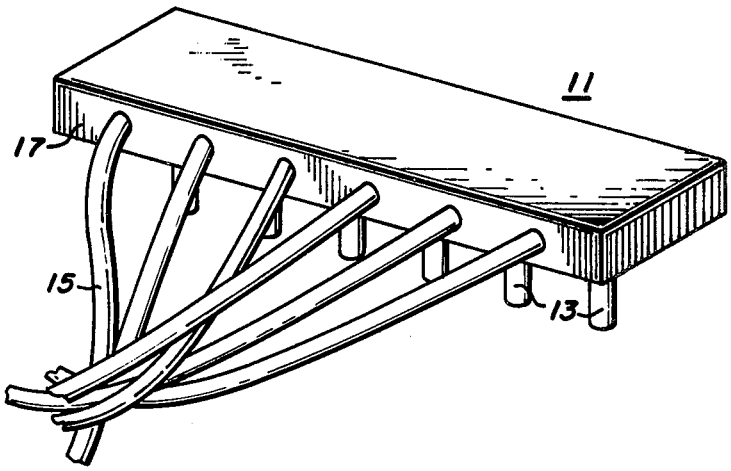
PRIOR ART Fig. 1
FIG. 1 is an elevated perspective view of a prior art electrical connector having at least one linear set of connector pins not co-linear with their associated lead wires and lead wire connections.

FIG. 1 shows a prior art connector 11 with connector pins 13 in a linear array and lead wire connections 15 on one of the connector sides 17. The prior art connectors are generally shaped as long, narrow rectangles since this most closely conforms to the shape of the linear array of connector pins. The wire leads 15 are usually soldered in a conventional manner to the pins of the connector to provide the necessary electrical continuity between the wire and pins. The quickest and easiest way to remove the connector 11 from its mating socket is to pull on the lead wires 15. By doing so, the connector side 17 with the lead wires attached will disengage the mating socket by pivoting about the connector side opposite the lead wire side 17. As the pivot angle increases, the angle through which the pins are bent as they disengage the mating socket also increases. In the connector 11 in FIG. 1 the angle of pin deflection will reach a point prior to total pin disengagement that results in so great a lateral strain on the exposed portion of the connector pins that it overcomes the yield strength of the pins and thus permanently bends them.

Figure 2A:
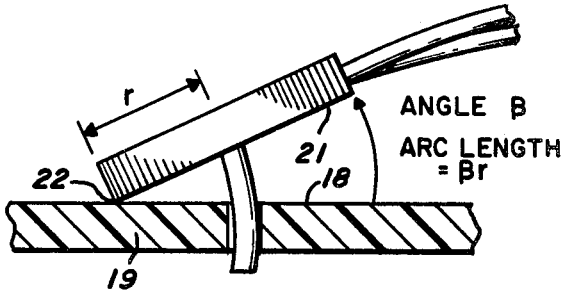
PRIOR ART Fig. 2A
FIG. 2*a* is a side view of the prior art connector of FIG. 1 during removal from its mating sockets by a pulling motion on the connector lead wires.

FIG. 2*a* shows a side view of connector 11 during removal from its mating socket 19. In FIG. 2*a* the angle B represents the angle between a connector bottom plane 21 and a top plane 18 of a mating socket 19.

Figure 2B:
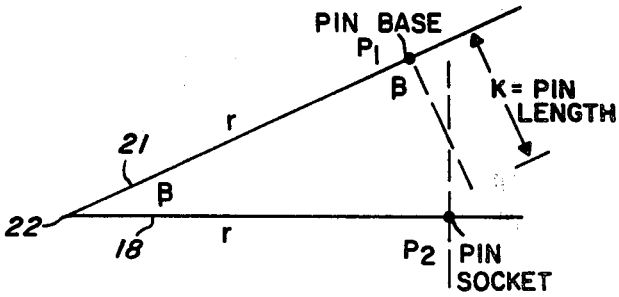
FIG. 2*b* is a geometric representation of the effective lever arm distances and angles involved in removal of the prior art connector as shown in FIG. 2*a*.

FIG. 2*b* is a geometric representation of the distances and angles involved in the removal of the connector assembly as shown in FIG. 2*a*. A certain arc length, as measured from $P_1$ to $P_2$, must be obtained as the connector pivots about its edge 22 before the pin length is free and clear of its socket. The arc length can be defined by the length of the pivot arm, (r) in FIG. 2*b*, multiplied by the angle B in radians. The value of the length of the connector pin measured from its tip to its base at the connector body bottom plane 21 can be symbolized as K as shown in FIG. 2*b*. The product of the angle B and the length of the pivot arm (r) must be equal to K before a connector pin is free from its socket.

From FIG. 2*b*, it can be seen that the angle B is also the angle which the connector pins must flex in order to be removed from their mating sockets. The pins 13 of connector 11 caan be distorted out of their linear shape and alignment while being removed from their sockets without fear of permanent damage as long as the force from the distortion does not overcome their yield strength. If the angle B required to create a sufficient arc length to free connector pins is too great, the pins will flex or bend to a point surpassing the resiliency of the pins and a permanent bend in the pins will result. In the prior art with a pivot arm length of r, the angle B results in a force that surpasses the yield strength of the pins.

Bent connectors are difficult to reengage into the mating socket. Straightening the pins is time-consuming and does not always result in satisfactory realignment of the pins. Fingertip tabs on the connector ends have been used to attempt to enhance ease of pulling of the connector body from the socket. Often though, a repairman or technician will not take the extra time neded to use the tabs, but will prefer to grab the lead wires and yank the connector free from its sockets. For connector 11, this will result in bent pins which are difficult to reinsert into the mating socket. Therefore, there is a need for a means of preventing pin distortion in a connector construction which maintains a low profile by having lead wire connections through one of its side walls. A connector constructed as disclosed herein minimizes the surface area of the connector body while assuring that a direct pull on lead wires mounted on the connector side will not permanently bend and distort the pins.

Figure 3A:
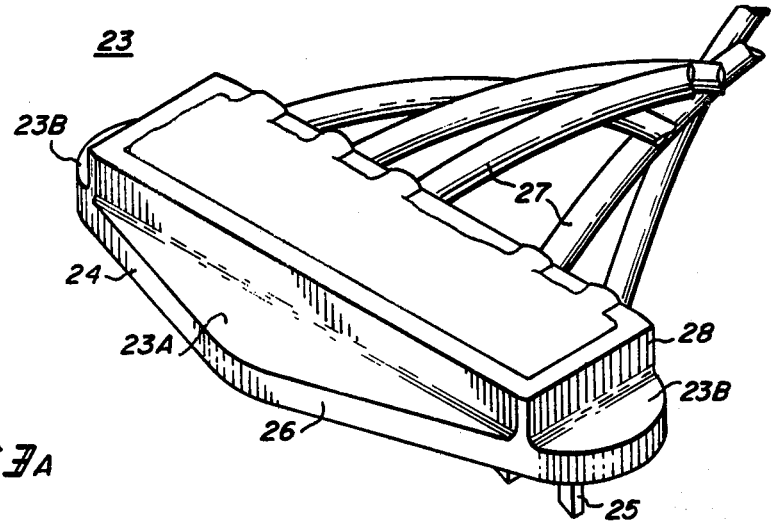
FIG. 3*a* is an elevated perspective view of the electrical connector according to the invention.

FIG. 3*a* is an elevated perspective view of a electrical connector according to the invention. The connector body 23 houses a linear array of connector pins 25. The front portion 23*a* of the connector body 23 is opposite the side which receives the input lead wires 27. The front portion 23*a* acts in combination with the remainder of connector body 23 as a means to reduce the lateral stress when the connector body 23 is removed from its mating socket by pulling on the lead wires 27. The shape of the top and bottom plane of connector body 23 is substantially a pentagon with rounded edges. Front portion 23*a* is a nose-like projection defined by two sides of the pentagon shape. The two sides are labeled 24 and 26. A third fourth side of the pentagon shape define the two rounded ends 23*b* of the connector top and bottom plane. The fifth side 28 of the pentagon receives the lead wires and is on the opposite side of the pentagon shaped connector from the front portion 23*a*. The pins 25 are arranged in a linear array essentially parallel with side 28.

Figure 3B:
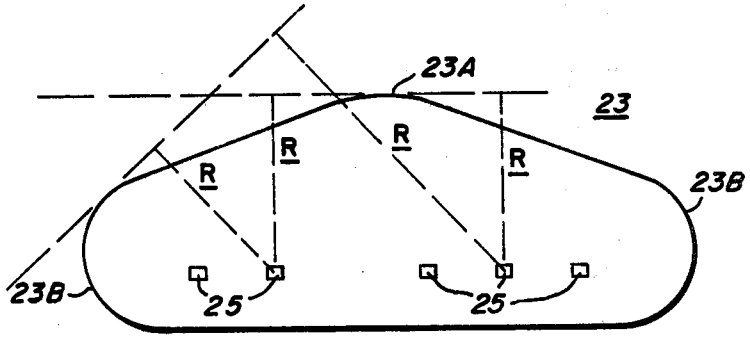
FIG. 3*b* is a top view of the connector according to the instant invention which includes in phantom varying effective lever arm lengths as the connector is removed from its mating socket.

FIG. 3*b* illustrates the longer lever arm gained by the presence of connector body part 23*a* in comparison to prior art connectors In prior art FIGS. 2*a* and 2*b* the distance between the connector pins and the line of contact on which the connector pivots is labeled r. In FIG. 3*b* the distance R is the distance from the connector pins of the invention to the line of pivot along the edge of connector part 23*a*.

FIG. 3*b* also illustrates how the shape of connector body part 23*a* and rounded ends 23*b* serve to increase the length of the lever arm acting on each pin. The connector body part 23*a* and rounded ends 23*b* cause the connector point of contact between the connector and its mating socket to cam toward the left hand side of the connector as viewed in FIG. 3*b*. As the connector body 23 cams to the left the pins on the right most end of the connector experience a lengthening of their effective lever arms as shown by R in FIG. 3*b*.

Figure 4A:
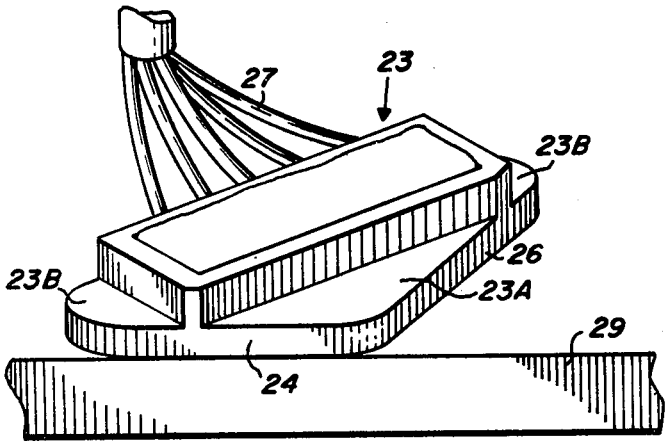
FIG. 4*a* is a frontal view of the connector according to the invention as it is pulled from its socket with a force having a component in a left hand direction.
Figure 4B:
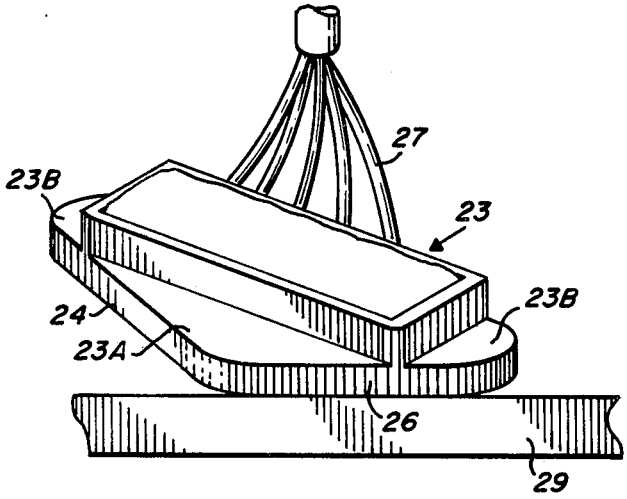
FIG. 4*b* is a frontal view of the connector according to the invention as it is pulled from its socket with a force having a component in a right hand direction.
Figure 4C:
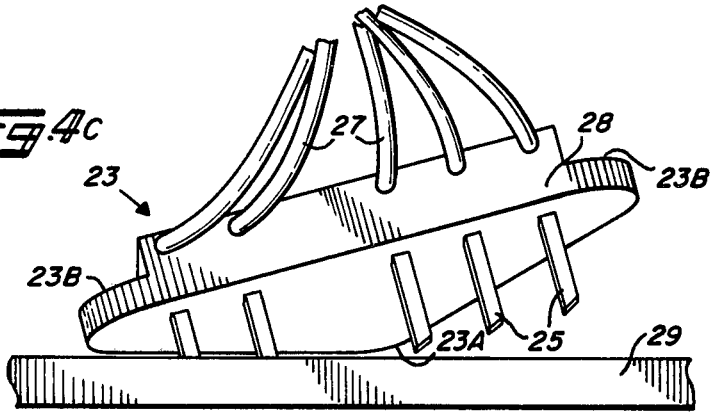
FIG. 4*c* is a rear view of the connector according to the invention as it is pulled from its mating socket in the manner shown in FIG. 4*b*.

FIGS. 4*a*, 4*b* and 4*c* show more clearly how the connector body front portion 23*a* interacts with the mating socket 29 as it leaves the socket in response to a pull on the lead wires 27. Depending upon the exact angle of the pull, the connector will pivot about side 24 of connector body front portion 23*a* as shown in FIG. 4*a* or side 26 of connector body front portion 23*a* as shown in FIGS. 4*b* and 4*c*.

In operation, as the wire leads are pulled in an effort to remove the connector from its socket, the connector first begins to pivot about the tip of connector front portion 23*a* which provides the connector pins with the longest possible effective lever arm. All the connector pins are partially removed by an approximately equal amount before the pivot point begins to move along side 26 or side 24 of the connector body front portion 23*a* in a camming motion. As illustrated in FIG. 3*b* the effective length of the lever arm changes as the camming progresses. Simultaneously the angle B is increasing as the lead wire side 28 in FIG. 4*c* of the connector is pulled farther from the socket. The effective lever arm length is measured as the length of a line from the pin in question perpendicular to a line tangent through the point of pivot. Such a line is shown in FIG. 3*b*. If the connector cams to the left, as shown in FIG. 3*b*, the pins farthest to the right will be associated with an effective lever arm that actually increases in length as the pivot point moves from the tip of connector front portion 23*a* toward the connector end 23*b*. The pins to the left-most side of connector 23, as shown in FIG. 3*b*, will have an effective lever arm that decreases in length as the pivot point cams from front portion 23*a* to connector end 23*b*. Since the right-most pins in FIG. 3*b* maintain a long lever arm, they are clear of their mating socket much more quickly than those pins on the left-hand side of FIG. 3*b*. FIG. 4*c* depicts this most clearly.

In principle, if the pins are not deflected through too large an angle the pins can be considered resilient for all practical purposes. The larger the portion of the connector pin that is removed from the socket, the larger the angle through which the pin can be distorted without surpassing the yield strength of the exposed portion of the pin. Since the left-most pins in FIG. 3*b* are exposed to the largest distortion angle B end their effective lever arm is the smallest while they are still partly engaged in a socket, they must have enough length outside the mating socket to absorb the angle B distortion imposed on them until they are free of the socket. If, in a camming pivot toward side 26 the left-most pins can be freed without permanent distortion then all other pins can also be freed. The initial pivoting at connector body part 23*a* provides an arc value at the left-most pin sufficient to clear enough of the pin length so it can withstand the strain of the high value of distortion angle B as the camming process shortens the effective lever arm.

Figure 5A:
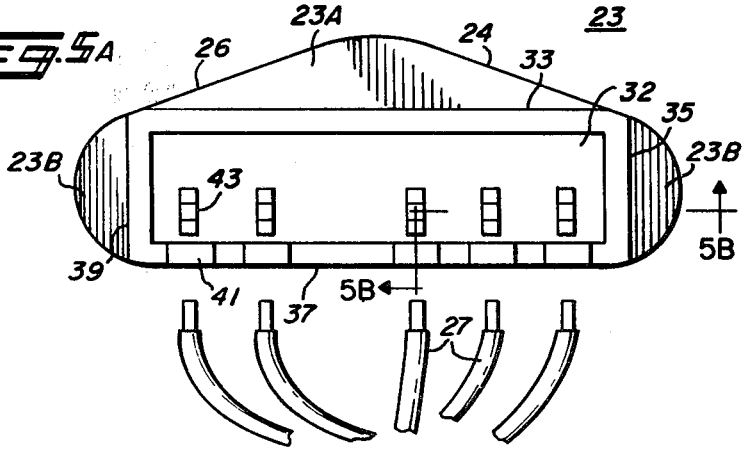
FIG. 5*a* is a top view of the preferred embodiment of an electrical connector according to the invention.

FIGS. 5*a*, 5*b*, 5*c* and 5*d* show the detailed preferred embodiment of the invention. FIG. 5*a* shows a top view of the connector body 23. The top of the connector body 23 is substantially a pentagon shape made of high impact nylon through an injection molding process. Within the boundary of the top of the connector body is a rectangular well 32 whose area is defined by four walls 33, 35, 37 and 39. Front portion 23*a* and connector ends 23*b* are the same as those described in connection with FIGS. 3*a*, 3*b*, 4*a*, 4*b* and 4*c*. Holes 43 through the connector body 23 are in a linear relationship and are located within the area of the well 32. The holes 43 receive the connector pins 25 during the assembly process. The pins 25 form a linear array parallel with connector body side 28. Five ports 41 in wall 37 serve as input means for lead wires 27. Wall 37 is flush with side 28 and in appearance defines a single side portion of the connector body 23. The connector body 23 is perferably constructed of high impact nylon by an injection molding process. FIG. 5*b* shows a partial cross-section of the connector body 23 in FIG. 5*a* as viewed from its back side. The well 32 defined by walls 33, 35, 37 and 39 can be seen to be placed atop the basic pentagon shaped connector body defined by sides 24, 26, 28 and rounded ends 23*b*.

FIG. 5*c* shows the connector pins 25 as they are manufactured by a stamping process carrief out on a carrier piece 45. The pins 25 are stamped in alternate groups of two and three. This conforms to the linear grouping of the connector body holes 43 in FIGS. 5*a* and 5*b*. During connector assembly the pins 25 are fitted through connector body holes 43 and snapped off from the carrier piece 45 along a score line 47 shown in the FIG. 5*d* side view of pin 25 and its associated carrier piece 45. After the connector pins 25 are fitted through connector body holes 43 the cable wires 27 are soldered to the pins 25 at pin hole 49 shown in FIG. 5*c*. After the solder joint is completed, the connector housing well is filled with a suitable potting compound which, when cured, provides a strong bond holding pins and wire in place. The potting offers protection from the strain placed on the wire and pin connection when the wire leads are pulled for the purpose of connector removal.

We claim:

1. An electrical connector assembly for association with lead wires and for insertion into a mating socket, said electrical connector assembly comprising:

a connector body having a top portion, a bottom portion and at least a first, second and third side portions, said first side portion receiving the lead wires, conductive pins projecting from said bottom portion and having a certain characteristic yield strength, said second and third side portions disposed relative said first side portion to meet at a point approximately opposite the midpoint of said connector body first side portion to form a nose-like projection, said second and third side portions and said nose-like projection being disposed such that a force exerted on said connector body first side in response to a pull on the lead wires causes said connector body to first pivot about said nose-like projection and then cam against the mating socket along either said second or third side portions resulting in the removal of said conductive pins from the mating socket without said pins experiencing a lateral force which exceeds their yield strength.

2. An electrical connector assembly according to claim 1 wherein said conductive pins are in a limnear array and said array is parallel to said first side.

3. An electrical connector assembly according to claims 1 or 2 wherein said top portion of said connector body includes four walls defining a well with a first wall being part of said first side portion of said connector body and said first wall having ports to receive said lead wires.

4. An electrical connector assembly according to claim 3 wherein said well includes openings which define holes connecting between said connector body bottom and top portion, said openings receiving said connector pins which project from said connector body bottom portion.

5. An electrical connector assembly according to claim 4 wherein said connector pins and lead wires are electrically joined by a solder joint located in said well with said well being filled with potting compound to protect said solder joint.

* * * * *

UNITED STATES PATENT AND TRADEMARK OFFICE

CERTIFICATE OF CORRECTION

PATENT NO. : 4,415,219

DATED : November 15, 1983

INVENTOR(S) : Virgil F. Kuhl
Gary J. White

It is certified that error appears in the above—identified patent and that said Letters Patent is hereby corrected as shown below:

In column 6, line 32 (claim 2), delete "limnear" and insert --linear--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*